United States Patent [19]

Freeman

[11] 4,006,317

[45] Feb. 1, 1977

[54] ELECTROSTATIC TRANSDUCER AND ACOUSTIC AND ELECTRICAL SIGNAL INTEGRATOR

[76] Inventor: Miller L. Freeman, 4221 Kling St. No. 4, Burbank, Calif. 91505

[22] Filed: Feb. 14, 1975

[21] Appl. No.: 549,867

[52] U.S. Cl. ..... 179/111 R

[51] Int. Cl.[2] ..... H04R 19/00

[58] Field of Search ..... 179/111 R, 111 E

[56] References Cited

UNITED STATES PATENTS

| | | | |
|---|---|---|---|
| 1,809,754 | 6/1931 | Steedle | 179/111 R |
| 1,831,278 | 11/1931 | Wolfe | 179/111 R |
| 2,863,953 | 12/1958 | Reed et al. | 179/111 R |
| 2,993,097 | 7/1961 | Swift | 179/111 R |
| 3,008,013 | 11/1961 | Williamson et al. | 179/111 R |
| 3,136,867 | 6/1964 | Brettell | 179/111 R |
| 3,892,927 | 7/1975 | Lindenberg | 179/111 R |

FOREIGN PATENTS OR APPLICATIONS

| | | | |
|---|---|---|---|
| 884,364 | 12/1961 | United Kingdom | 179/111 R |
| 422,724 | 1/1935 | United Kingdom | 179/111 R |
| 387,546 | 2/1933 | United Kingdom | 179/111 R |
| 1,239,658 | 7/1971 | United Kingdom | 179/111 R |

*Primary Examiner*—George G. Stellar
*Attorney, Agent, or Firm*—Edwin A. Oser

[57] ABSTRACT

An electrostatic transducer of the type comprising electrically conductive plates and a conductive, flexible, vibratable diaphragm. The transducer may either be a flat radiator or of the folded type. The surface area of the plates is substantially smaller than that of the diaphragm. Additionally, the plates are preferably staggered to reduce both capacitance effects and the required driving power. The plates may be of different sizes to control dispersion of the sound. Instead of applying an electric bias to the structure, an electret may be used to obviate the necessity of a bias field. The transducer may be used as both a loudspeaker or a microphone. It may be driven by electric signals or partially by electric signals and acoustic waves thus forming an integrator. Finally, it may be driven solely by acoustic waves.

17 Claims, 22 Drawing Figures

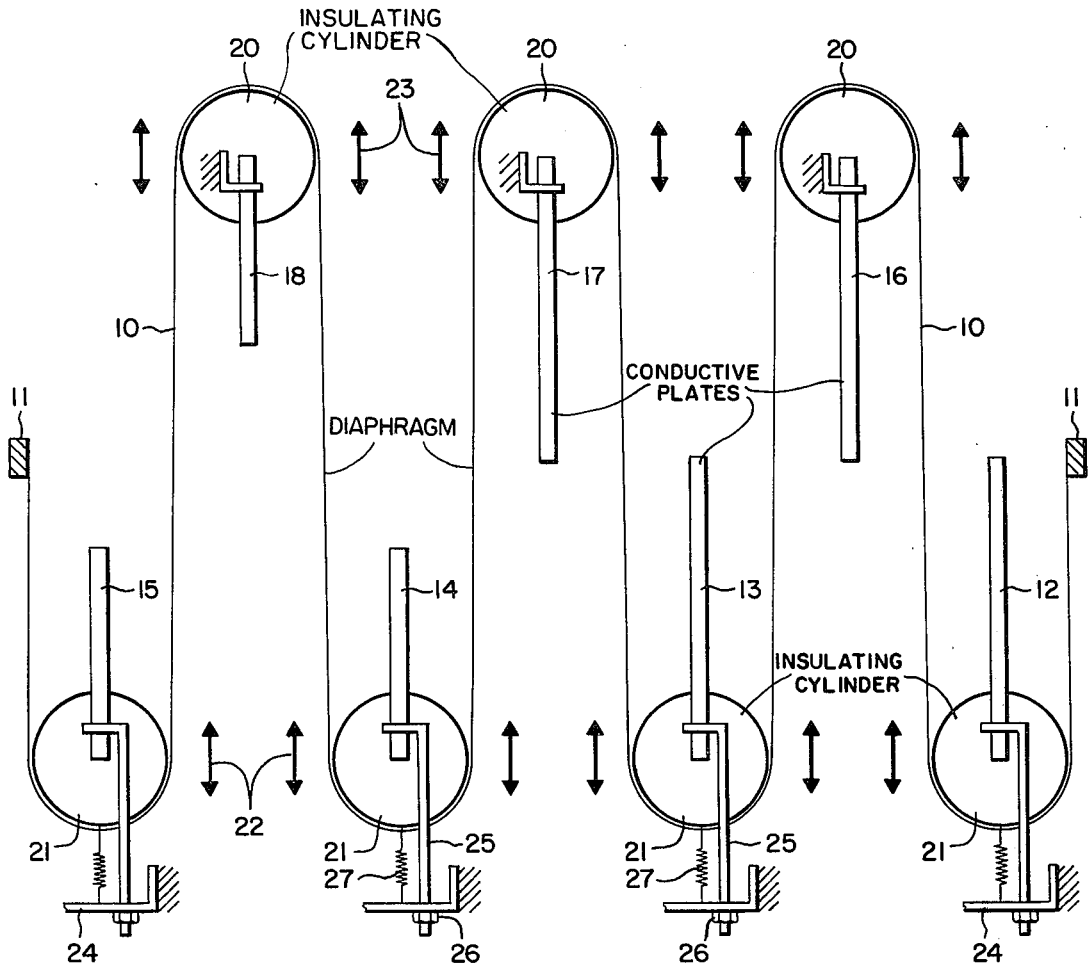
*Fig. 1* TOP PLAN VIEW

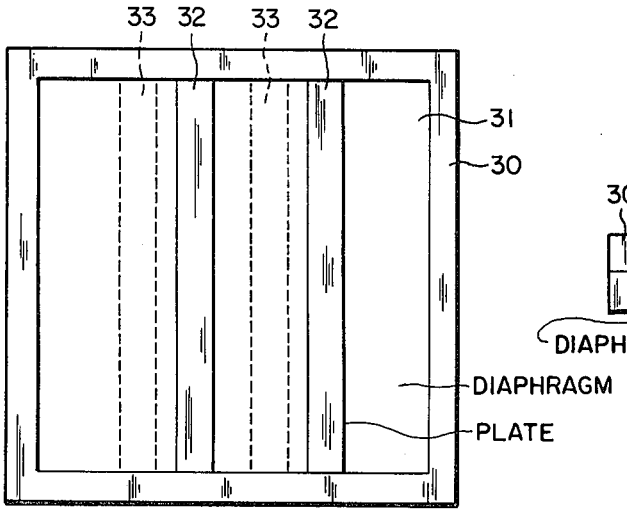
Fig. 2 SIDE VIEW
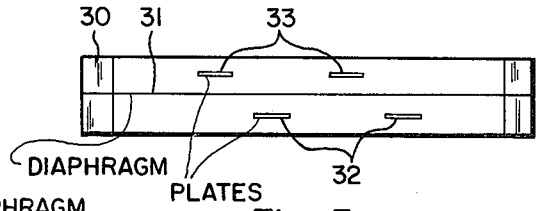
Fig. 3
TOP PLAN VIEW
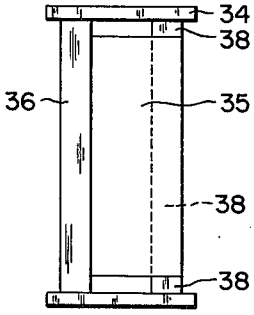
Fig. 4 SIDE VIEW
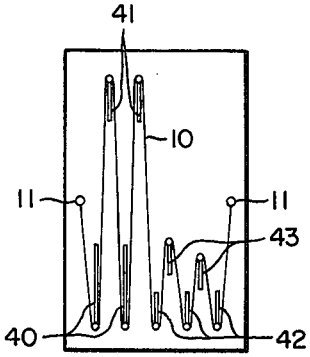
Fig. 5 TOP PLAN VIEW
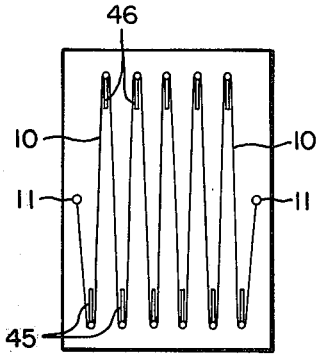
Fig. 6
TOP PLAN VIEW
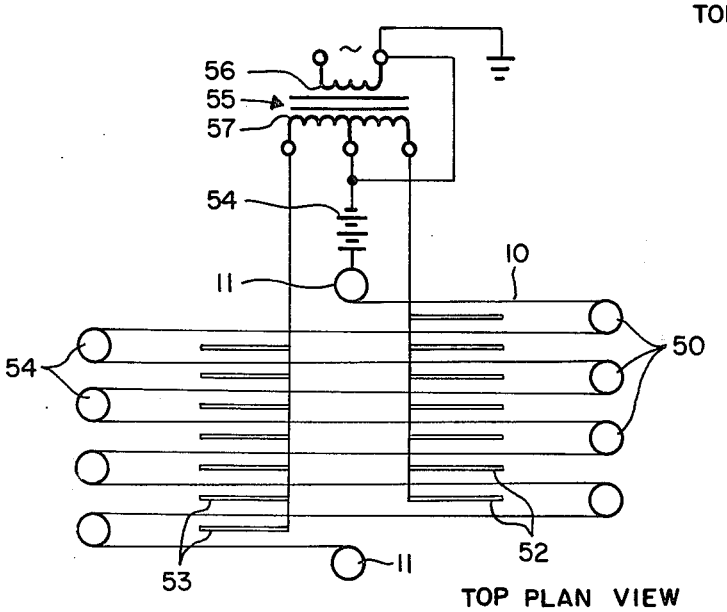
TOP PLAN VIEW
Fig. 7

FRONT ELEVATIONAL VIEW

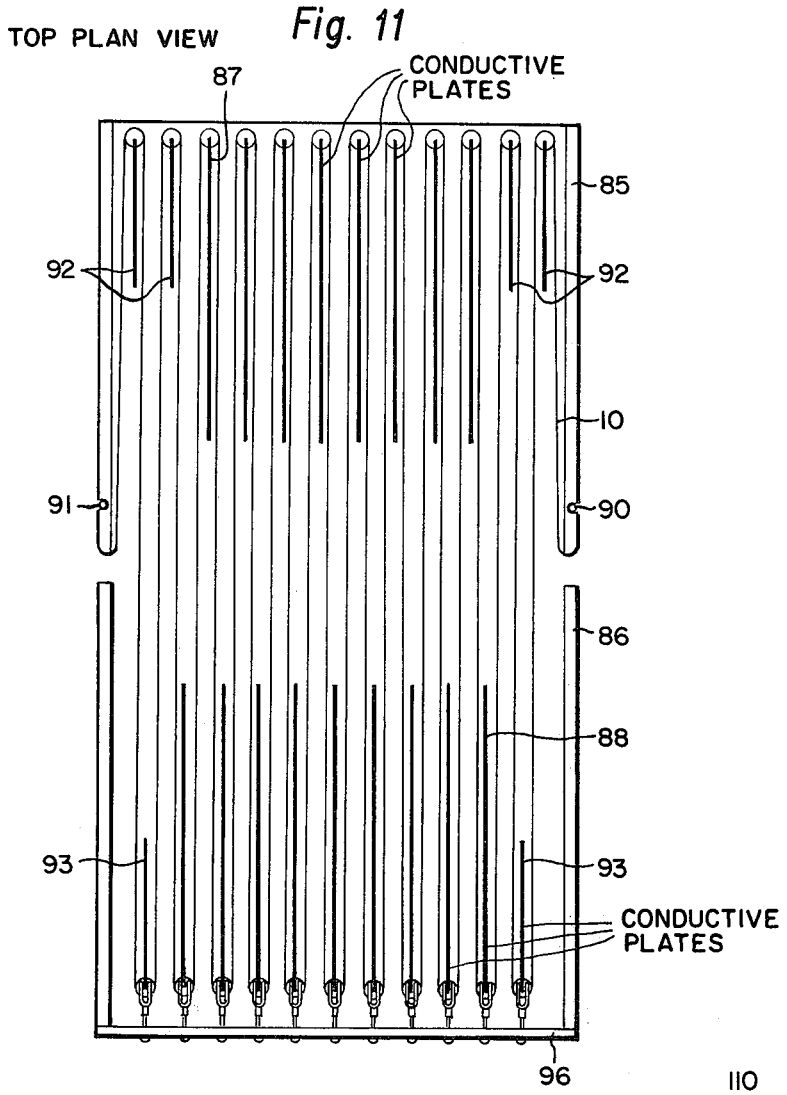
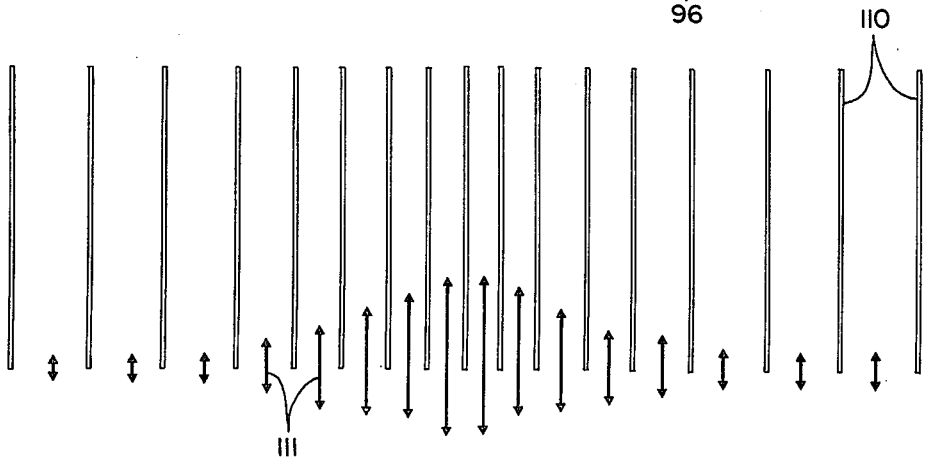
Fig. 14

ENLARGED TOP PLAN VIEW

ENLARGED SIDE VIEW

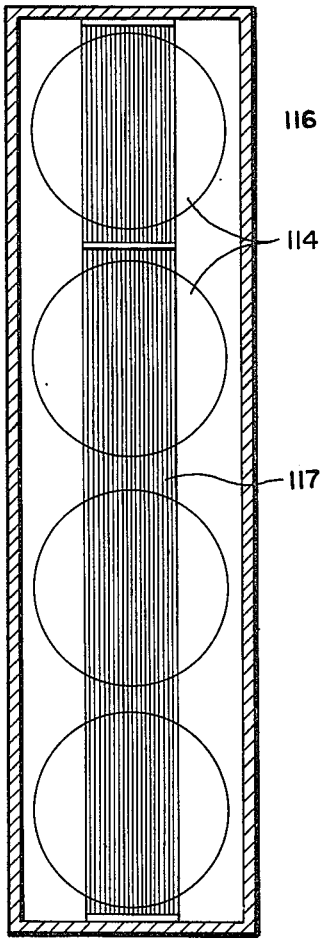
Fig. 15 REAR VIEW ON LINE 15–15 OF FIG. 17
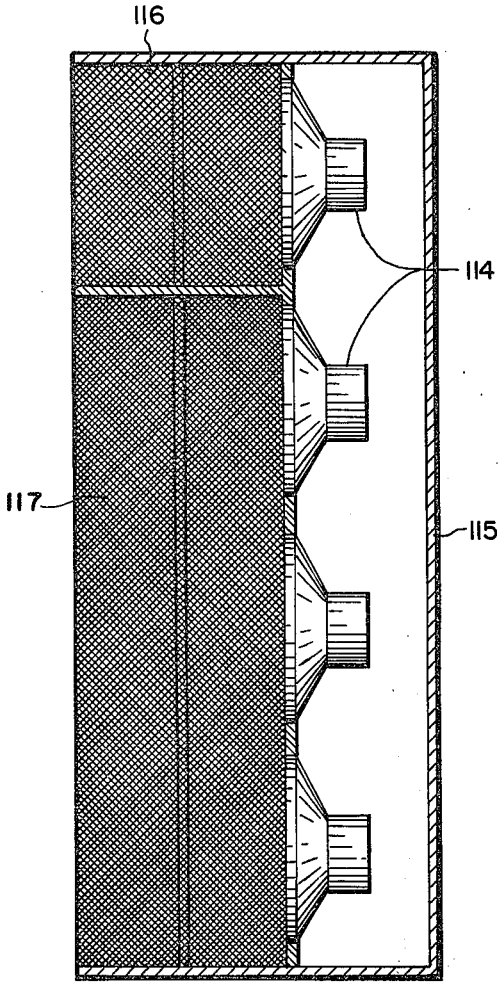
Fig. 16
SIDE ELEVATIONAL VIEW
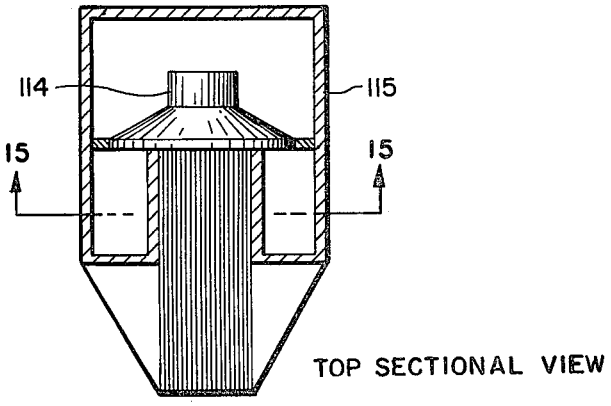
TOP SECTIONAL VIEW
Fig. 17

FRONT ELEVATION VIEW

SIDE ELEVATION VIEW

SAME AS FIG. 18 ROTATED 180°

FRONT ELEVATIONAL VIEW

SIDE ELEVATIONAL VIEW

ELECTROSTATIC TRANSDUCER AND ACOUSTIC AND ELECTRICAL SIGNAL INTEGRATOR

BACKGROUND OF THE INVENTION

This invention relates generally to transducers and particularly relates to a device for converting electric signals into acoustic signals or which may be driven partly or solely by acoustic waves.

Electrostatic transducers, that is loudspeakers or microphones, have been known in the art. They present a number of advantages. In particular, they are superior to most other loudspeakers for the reproduction of sound. They generate a clean sound and have a minimum of distortion. The reason is that the flexible diaphragm is moved uniformly over its entire surface by electrostatic force. Accordingly, the diaphragm doesn't have the tendency of conventional loudspeakers to be distorted or to break up into portions, each of which vibrates in a different mode.

An electrostatic loudspeaker is superb in the higher frequency range; however due to its mode of operation it needs to be rather large and requires considerable power to reproduce the low audio frequencies. For this reason a conventional loudspeaker to cover the entire audio range becomes large and hence cumbersome and is very directional.

Conventional electrostatic transducers are flat radiators. However, electrostatic transducers of the folded type have also been suggested in the U.S. Pat. Nos. to Williamson et al., 3,008,013 and 3,008,014. However, according to the Williamson et al. structure the fixed plates are disposed opposite each other and hence present a large capacitive load that does no useful work. In the conventional type of electrostatic transducers the sound must emerge at right angles to the planes of the conductive plates and therefore the plates need to be perforated. The edges of the perforations assume a charge which is higher than that of the flat surface of the plate and therefore the electrostatic pattern is both interrupted and made non-uniform. Also, at these perforations the insulation may break down. Finally, because the sound must pass through the perforations, the thickness of the insulation which may be used at these perforations is limited.

Furthermore, the large, flat loudspeakers in accordance with these patents provide a soundwave which is quite directional. This in turn may produce standing wave patterns in the room in which the loudspeaker is located so that localized loud and soft areas are created in the room due to interference patterns.

In an electrostatic loudspeaker the frequency response is proportional to the reciprocal of the square of the area of the diaphragm. On the other hand, the power required to drive the loudspeaker is directly proportional to the area of the fixed plates. This power is increased by the fixed capacitance which originates due to the fixed plates. By way of example, a loudspeaker having an area of 9 square inches produces sound at a frequency above one kilohertz (kHz) and requires one watt of driving power. On the other hand, in order to reproduce sound as low as 30 Hz an area of 100 sq. ft. is needed. In order to drive such a large loudspeaker a power of 1,000 watts is needed. Specifically, a large amount of power is required to drive a loudspeaker capable of reproducing audio frequencies, say below 40 Hz (Hertz) and specifically below 20 Hz.

It is accordingly an object of the present invention to provide an electrostatic loudspeaker where the area of the plates is substantially smaller than that of the diaphragm and where the plates are staggered and hence decoupled from each other, thereby to reduce the capacitance due to the plates and hence the necessary driving power.

Another object of the present invention is to provide an electrostatic loudspeaker of the folded type where one set of plates is made adjustable to adjust the tension of the diaphragm, thereby to vary the electrical resonance between a plate and its associated diaphragm portion so as to detune the transducer.

A further object of the invention is to extend the frequency range of a single electrostatic transducer to cover the entire audio range without requiring special units, which may be driven at low power and which may be constructed at reduced cost.

Still a further object of the invention is to provide an electrostatic transducer of the type discussed which is not directional, that is which creates a dispersive soundwave with superior acoustic coupling to the air and which provides a large area in a relatively small space.

Still another object of the present invention is to provide a transducer of the type discussed which can be driven partially or entirely by sound waves and which may therefore operate as a wave integrator.

Yet a further object of the present invention is to provide an electrostatic transducer having a diaphragm consisting of an electret, thereby to obviate the necessity of providing an electric battery.

SUMMARY OF THE INVENTION

Basically, an electrostatic transducer in accordance with the present invention comprises a plurality of electrically conductive plates and an electrically conductive, flexible and vibratable diaphragm. The plates are disposed in substantially parallel, spaced planes. Means are provided for spacing the diaphragm from the plates and for tensioning the diaphragm. In accordance with the present invention the surface area of the plates is substantially smaller than the surface area of the diaphragm. Further, the plates preferably are staggered. This will materially reduce the capacitance effects due to the plates and hence the necessary driving power. Finally, the plates need not all be of the same size. Finally, a direct-current bias voltage is applied between the plates and the diaphragm. On the other hand, the electrical signal is applied between alternate plates.

The electrostatic transducer of the invention may be of the conventional flat type or it may be of the folded type. In the latter case, the diaphragm may be guided by insulating members disposed along one edge of the plates. Alternatively, the diaphragm may be guided and tensioned by means separate from the plates.

According to a further modification the diaphragm may consist of an electret or the like which can hold an electric charge over an extended period. As a result, there is no need to apply a steady electric field as a bias field.

It will be apparent that the transducer of the invention can also be used as a microphone. In addition it has been found that the transducer of the invention can be excited not only by electric signals, but by sound waves. Hence, the transducer may be driven partially or entirely by another loudspeaker. Hence, the device operates as an integrator because it will integrate electric signals with sound waves. This has the added advantage that the low frequencies can be generated by a separate eletromagnetic loudspeaker and this will greatly reduce the required power.

The novel features that are considered characteristic of this invention are set forth with particularity in the appended claims. The invention itself, however, both as to its organization and method of operation, as well as additional objects and advantages thereof, will best be understood from the following description when read in connection with the accompanying drawings.

BRIEF DESCRIPTION OF THE DRAWINGS

FIG. 1 is a schematic top plan view of an electrostatic transducer embodying the present invention;

FIGS 2 and 3 are respectively a side view and a top plan view of an electrostatic transducer of the type having a flat radiator;

FIG. 4 is a side view of another embodiment of an electrostatic transducer in the form of a folded radiator;

FIGS. 5 and 6 are top plan views of different embodiments of a folded electrostatic transducer of the invention, one having different size sound slots;

FIG. 7 is a top plan view and circuit diagram of still another embodiment of the transducer of the invention;

FIG. 11 is a top plan view of a still further embodiment of the transducer of the invention having plates of different sizes;

FIG. 14 is a schematic top plan view of another embodiment of the invention having different sizes of the sound slots to provide dispersion of the sound.

FIGS. 15, 16 and 17 are respectively a rear view taken on line 15 – 15 of FIG. 17 a side and a top sectional view of an embodiment of the invention which is partially or entirely driven by an electromagnetic loudspeaker;

DESCRIPTION OF THE PREFERRED EMBODIMENTS

Figure 9:
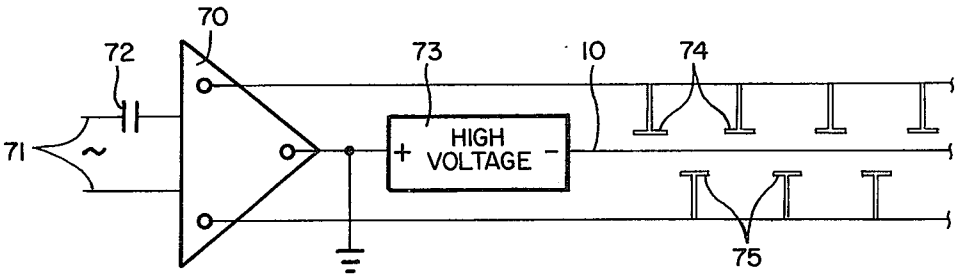
FIGS. 9 and 10 are schematic circuit diagrams illustrating different embodiments of the transducer of the invention, one showing a high voltage amplifier, the other a transformer.

Referring now to the drawings wherein like elements are designated by the same reference numbers and particularly to FIG. 1, there is illustrated an electrostatic transducer of the folded type. The transducer comprises a diaphragm 10 which extends continuously in serpentine fashion to form loops between two fixed supports 11. Disposed in parallel, spaced planes is a set of electrically conductive plates, one set being designated 12, 13, 14 and 15, while the other set is designated by 16, 17 and 18.

The diaphragm 10 consists of a flexible and vibratable material having an electrically conductive coating such, for example, as mylar which is a polyester film. Alternatively, an electret or the like, that is a plastic material, may be used which can hold an electric charge over an extended period. In this case there is no need for an electric bias voltage because the electret is sufficient to generate a steady electric field between the plates 12 – 18 and the diaphragm 10. The plates 12 – 18 may, for example, consist of aluminum which may be insulated with a suitable insulating material such as polyvinyl.

Each of the plates 12 – 18 is of rectangular shape. Along the front edges of plates 12 – 15 are disposed insulating members 20 of substantially cylindrical shape about which the diaphragm 10 extends. The insulating members 20 have an opening of substantially rectangular outline through which one of the plates 16 – 18 extends and may, for example, consist of teflon or polytetrafluoroethylene or of nylon which is a polyamide. Similarly, the set of back plates 12 – 15 is each provided with an insulating member or channel 21 of cylindrical shape about which the diaphragm 10 extends.

It will be noted that the plates 12, 13 and 16, 17 are of equal and relatively long length. On the other hand, the plates 14, 15 and 18 are relatively short, but again of equal length. In any case, it will be noted that the total area of the plates 12 – 18 is substantially less than that of the diaphragm 10.

By way of example, the sound slot between say plate 13 and its associated diaphragm portions may be 6 inches deep, the transducer may be 4 feet high and one foot wide. The spaces between adjacent plates may be of the order of ¼ inch. The total area is 192 square feet for the series of slots which have an area of 1 foot X 4 foot.

As indicated by the arrows 22 and 23, the sound radiates in both front and back directions. However, the sound wave emerging from the front is 180° out of phase with respect to that of the back. Therefore, baffles may be required to block one set of sound waves as is conventional.

The depth of each sound slot need not exceed ¼ of the wavelength at the lowest frequency. However, the slot may be larger than that.

A deep slot will reproduce high frequencies, but a shallow slot will not reproduce low frequencies. Therefore, the slot should always be deep enough to reproduce both high and low frequencies. Thus, a particular slot formed, for example, by the plate 13 and the adjacent diaphragm portions is closed by the insulating member 21 at one end and open at the opposite end. The electric signal is applied between alternate plates and accordingly the diaphragm is attracted by one plate, say plate 13, and repelled by the adjacent plate, say plate 16, thus causing the diaphragm to move in the same direction. Therefore, as the diaphragm vibrates the air in the slot is, for example, compressed and must escape through the narrow opening at the end of the slot. This in turn means that the air is greatly accelerated relative to the small opening of the diaphragm and is projected into the atmosphere at great velocity. Similarly, if the diaphragm moves in the opposite direction, a vacuum is created at the opening of the slot and air is drawn into the slot from the atmosphere. This limits the ratio of the depth of the slot to its width.

In general, in the construction of transducers one tries to avoid ionizing of the air. This takes place when the voltage exceeds 70 volts per mil (0.001 inch). However, with good insulation it is feasible to operate the transducer even though the air is ionized. In that case, the insulation, for example, may consist of polyvinyl chloride. Ionizing of the air has a certain advantage because electrically charged molecules of the same polarity tend to repel each other. Therefore, the sound-wave produced by the transducer in operation will tend to assume a higher velocity and hence the sound has a higher amplitude. The electric surface resistance of the diaphragm 10 may vary according to the various designs and purposes. However, it may be on the order of 100 kilohms per unit surface.

It has been found difficult to provide uniform tension on the diaphragm from its supports 11. Hence in accordance with the present invention alternate insulating members such as the members 21 are made adjustable with respect to a fixed support 24. This may be effected by an L-shaped member 25 fixed to one of the plates, say plate 13 while its other end is threaded so that it may be moved or adjusted by a nut 26 positioned on the plate 24. A spring 27 may serve the purpose to provide uniform tension. Hence the springs 27 control the tension and tend to equalize it for the different members 21.

It should be noted that the tensioning device 25, 26 may cause the diaphragm to be disposed at an angle with respect to the plates and this, of course, may be desirable for certain applications.

This tensioning of the diaphragm is not only convenient but provides a number of advantages. By moving one of the plates, that is one of the plates 12 – 15 with respect to the others the symmetry between the plates and the diaphragm is destroyed. This in turn changes the resonant frequency of each individual unit, say plate 13 with its associated diaphragm portions. This detuning prevents the entire transducer from being a self-resonating device which, of course, would be highly undesirable in a loudspeaker.

It should be noted that the electrostatic attraction is reduced by the square of the distance. Similarly, the capacitive coupling increases by the square of the distance between the fixed and the moving elements. This would indicate that the distance between diaphragm and plates should be made as small as possible. On the other hand, a wider spacing yields a more linear response.

Concerning the smaller plates such as 14, 15 and 18, it should be noted that they will still drive the surface of a large diaphragm with great efficiency and therefore there is no need to have large plates.

Referring now to FIGS. 2 and 3, there is illustrated a so-called flat or conventional electrostatic transducer. The transducer comprises a frame 30 which may, for example, be rectangular and between which a diaphragm 31 is stretched in a single plane. Two pairs of rigid plates 32 and 33 are provided on opposite sides of the diaphragm 31 and are disposed staggered with respect to each other. This in turn reduces the capacitance or the capacitive coupling due to the plates and hence greatly decreases the required driving power. It will also be noted that the diaphragm 31 is not supported by the plates 32, 33.

Due to the attraction between the plates 32, 33 and the diaphragm 31 caused by the existing electric field the diaphragm is forced to assume a slightly corrugated shape instead of being attracted to one side or the other. This also eliminates the shorting effect of the fixed plates 32, 33 across the variable capacitance between the diaphragm 31 and the plates. Hence this construction achieves the efficiency of a single-ended condenser but retains advantages inherent in a push-pull configuration.

In addition the instantaneous load on the driving amplifier will be only one half that normally required for a single-ended unit of the same area. At the same time, the instantaneous load is a small fraction of the load presented by a push-pull unit with its fixed capacitance loss.

When used as a microphone, the efficiency of the single-ended design is maintained while the linearity of the push-pull design is gained. Furthermore, the attraction between the diaphragm and the fixed elements is balanced.

Still another embodiment of a folded radiator is shown in FIG. 4 which again is provided with a frame 34 between which a diaphragm 35 is stretched. In front of the diaphragm 35 there is a group of plates 36 extending across the length of the frame while on the opposite side of the diaphragm a group of plates 38 extends across the length of the transducer.

FIG. 5 shows an electrostatic transducer where the depth of the slots is of different size. The reason for this is that for the high frequencies only short slots are required while the long slots are for the low frequencies. Thus, again a diaphragm 10 is stretched between two fixed supports 11. It will be noted that the diaphragm 10 has different lengths between plates 40, 41 and between plates 42, 43. The first two pairs of plates 40 and 41 are of substantially equal size and relatively long. The remaining plates 42 and 43 are relatively short and the thus-formed slots are of decreasing size. Thus, the plates such as 40 to 43 need not be of the same size. In order not to obscure the drawing the detailed manner of suspending and tensioning the diaphragm 10 has not been illustrated. However, it will be understood that it may be similar to the embodiment of FIG. 1.

FIG. 6 schematically shows a similar embodiment where, however, two sets of plates 45 and 46 are of equal length as are the slots formed thereby. Such an embodiment has equal plates and equal slots and hence should also operate over a wide audio range. It will be noted that in both embodiments of FIGS. 5 and 6 the plates 40 – 43 and 45 – 46 are disposed at the points where the diaphragm reverses direction, that is at the ends of each loop of the diaphragm.

FIG. 7 illustrates another embodiment of the transducer of the invention together with a circuit diagram. The diaphragm 10 is secured to two fixed supports 11 and is guided about a plurality of insulating members 50 and 51 on opposite sides. The two sets of plates 52 and 53 are of equal length and are spaced from the insulating members 50 and 51. Hence, again the diaphragm 10 is not supported by the plates 52, 53.

A direct-current voltage which may be on the order of several kilovolts may be applied by a high-voltage source shown here as a battery 54 between the diaphragm 10 on the one hand and all of the plates 52 and 53 on the other hand. The electric signal is supplied by a transformer 55 having a primary winding 56 and a secondary winding 57. The secondary winding has a center tap connected to one pole of the battery 54 and to ground, as is one terminal of the primary winding 56. The two sets of plates 52 and 53 are respectively connected to the outer terminals of the secondary winding 57 to drive the plates in phase opposition. As will be subsequently shown in connection with FIGS. 9 and 10, other input circuits may be used instead.

Figure 8:
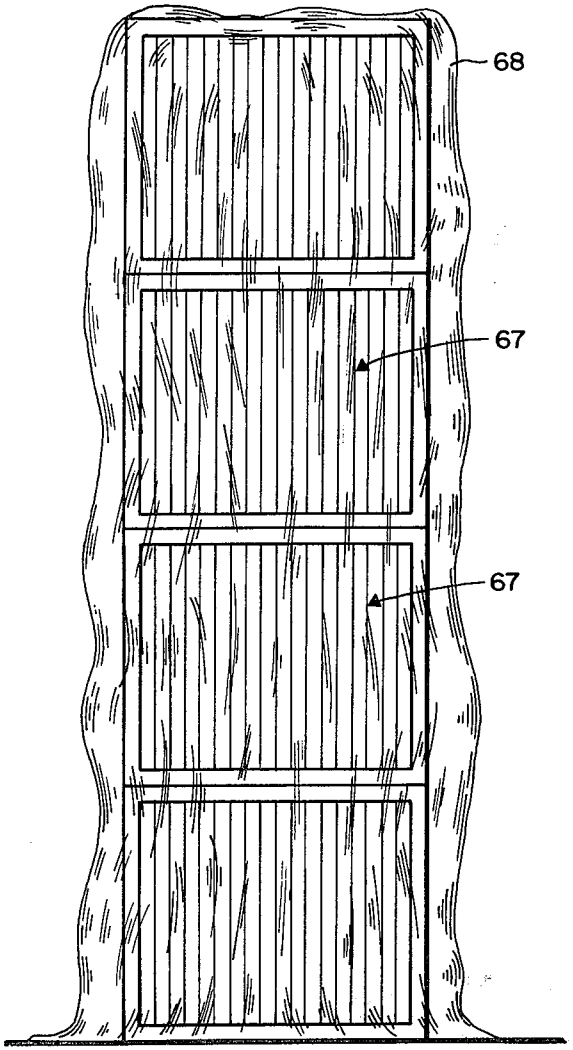
FIG. 8 is a front elevational view of a plurality of units disposed on top of each other of the folded type showing modular construction provided with an insulating cover to exclude moisture and dust.

FIG. 8 illustrates a plurality of electrostatic transducers 67 according to the invention put on top of each other. This may be desirable either to provide different units of different audio ranges or to provide a larger area without requiring an excessively large unit. In accordance with the present invention the various units are enclosed by a bag 68 of a suitable plastic material which is substantially permeable to sound. Since the soundwaves do not actually move the air very far, a light, plastic bag will faithfully follow the motions of the air.

Figure 10:
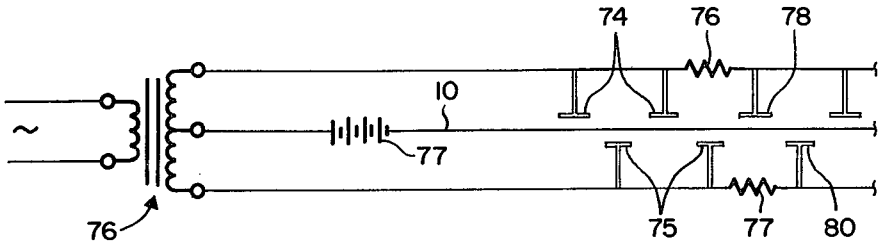

FIGS. 9 and 10 show schematically other electrical connections which may be made in accordance with the invention. Thus, in FIG. 9 there is provided a high-voltage, direct- current amplifier 70 having two input terminals 71 connected to the amplifier 70 by a blocking capacitor 72 for blocking direct currents. The high voltage supply 73 is connected between the diaphragm 10 and ground as shown. Again, alternate plates 74 and 75 are driven in phase opposition. The plates 74 and 75 are staggered with respect to each other.

Another way of providing a dispersed soundwave is illustrated in FIG. 10. Again there is a conventional input transformer 76 and a bias supply or battery 77 connected to the diaphragm 10. The plates 74 and 75 have the same configuration as previously shown. However, resistors 76 and 77 may be disposed between adjacent plates. These resistors will reduce the amplitude of the signal applied to say plates 78 and 80. Hence the resistors have the same effect as varying the magnitude of the slots.

Figure 12:
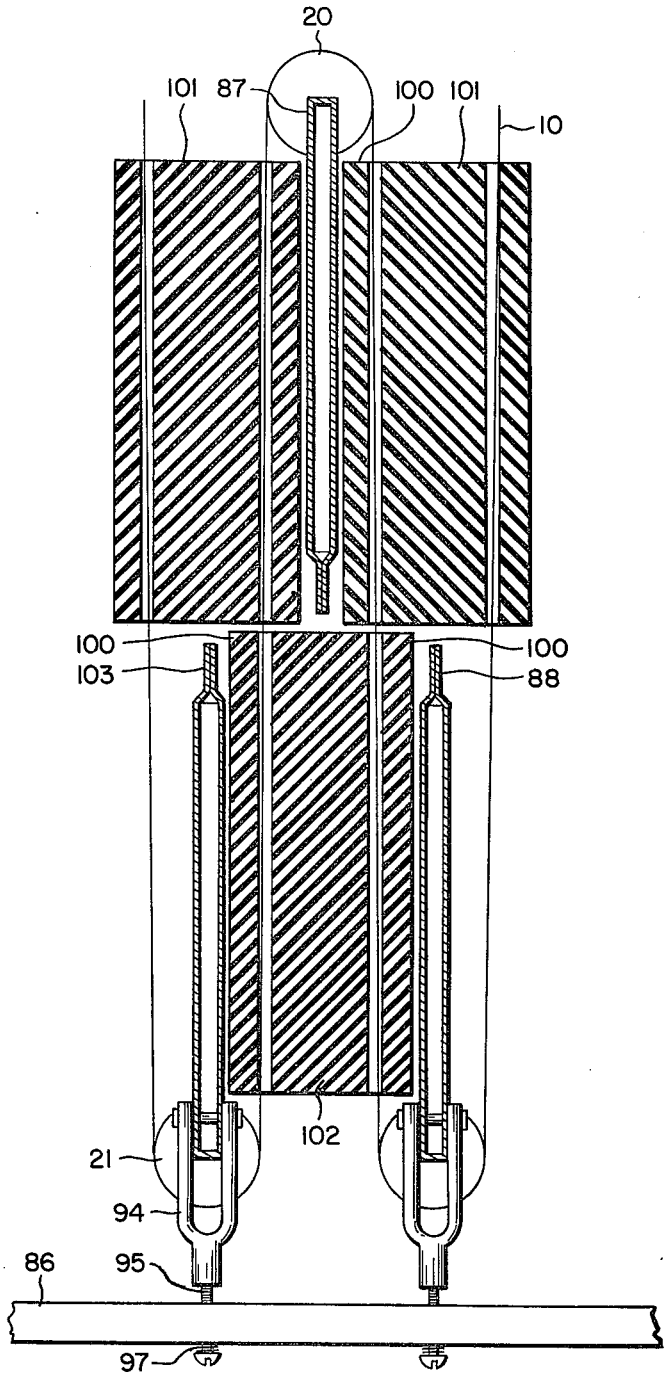
FIGS. 12 and 13 are respectively an enlarged top plan view and a side view of the embodiment of FIG. 11 to illustrate constructional details thereof.
Figure 13:
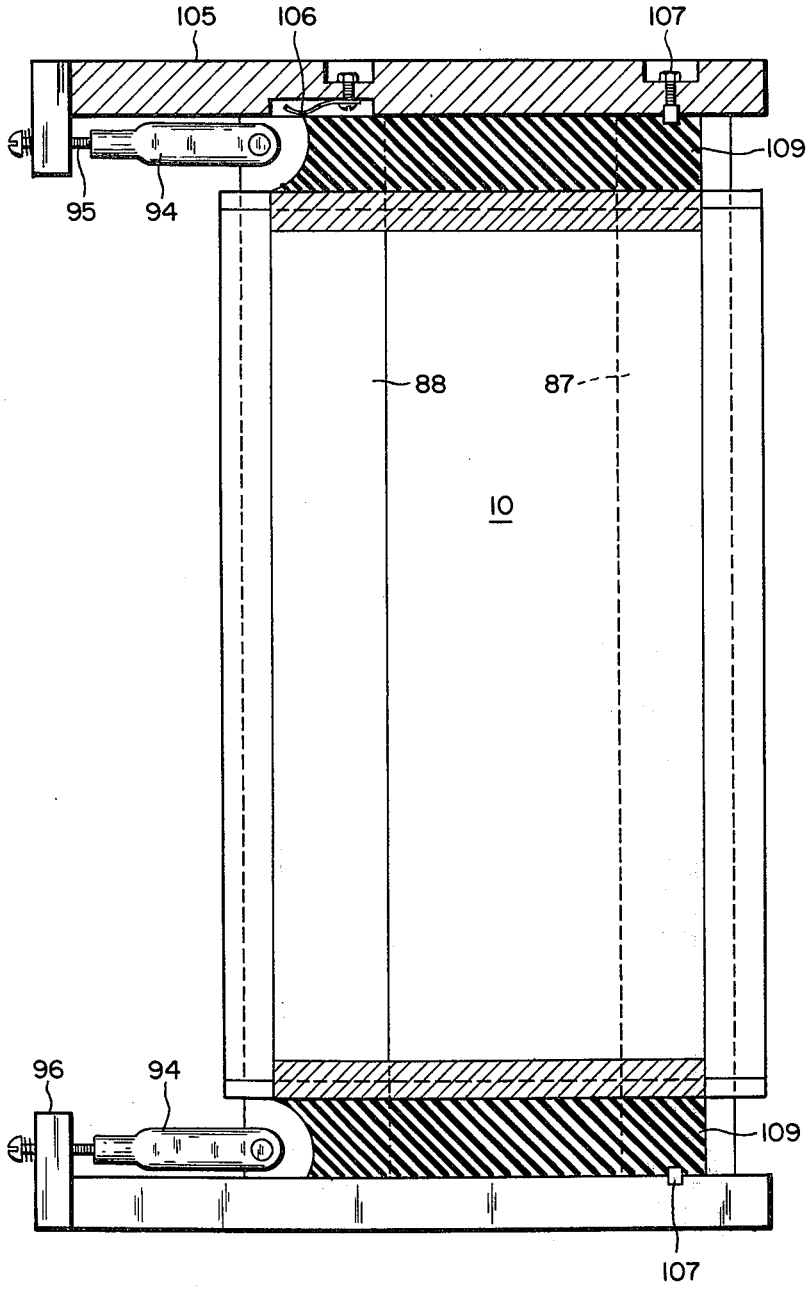

Referring now to FIGS. 11 – 13, there is illustrated still another embodiment of the present invention and the details of its construction. As shown schematically in FIG. 13, the unit may include a front frame 85 and a rear frame 86 upon which a front set of plates 87 and a rear set of plates 88 is mounted respectively. As shown in FIG. 11, the diaphragm 10 is stretched in a zig zag fashion between two clamps 90 and 91 disposed in the front frame 85. It will be noted that two of the outer pairs of the front plates 87, that is plates 92 are shorter than the others. Similarly, the two outer plates 93 of the rear set of plates are also shorter than the others.

As shown particularly in FIGS. 12 and 13, the diaphragm 10 is passed around an elongated insulating member 20 as previously described which provides high voltage insulation. Similar insulating members 21 are provided at the rear portion of the transducer. The rear insulating members 21 are adjustably mounted each on a respective insulated clevis indicated at 94, the position of which may be adjusted by screws 95 extending through a fixed supporting plate 96 forming part of the upper and lower frame 86. The screws 95 may pass through springs 97.

Insulating spacers 100 are disposed between say the plates 88 and the diaphragm 10. Furthermore, similar insulating spacers 101 are disposed between adjacent loops of the diaphragm 10 in the upper portion and a similar spacer 102 is disposed between adjacent loops of the diaphragm in the lower portion. Such insulating spacers between the diaphragm 10 and the plates 87 or 88 may, for example, consist of strips of felt. They serve the purpose to prevent the diaphragm from touching the plates and hence assure proper operation. A high voltage insulating material 103 is disposed about each of the plates to electrically insulate it from the diaphragm. Insulating spacers 109 (see FIG. 13) are provided at the top and bottom from the ends of the plates 87 and 88 to the frame 86.

Finally, an audio signal source may have one terminal connected by a conductor 105 and a flexible blade 106 to the rear set of plates 88. The front set of plates 87 which are fixed are connected to the audio signal source 180° out of phase by means of the connection 107. Hence the front plates 87 and the rear plates 88 are driven in push-pull by the audio signal.

It will be realized that by providing the plates such as 87 and 88 at the front and rear end of the transducer, the diaphragm may be driven to greater excursions without the danger of short circuits.

For some purposes it may be desirable to generate a curved wavefront to disperse the sound. This may be effected with the embodiment of the invention shown schematically in FIG. 14. For the sake of simplicity the diaphragm 10 has been omitted. Here successive plates such as 110 are spaced apart more and more widely from the center in an outward direction. As a result, the air is moved at a greater velocity as shown by the arrows 111. This will create a curved wavefront and hence a greater dispersion of the sound.

It has been explained hereinabove that in order to reproduce low audio frequencies, that is those say below 40 hz, it is necessary to provide a relatively large transducer structure. For the same reason the driving power is increased many fold. Thus, by way of example, it may be necessary to reproduce audio frequencies below 40 hz to use four separate units having a combined area of 100 sq. ft. This, of course, will increase the price appreciably.

It has been found that the transducer of the invention will also reradiate or reproduce sound waves which have been directed upon it. Therefore, instead of generating the low frequency sound waves directly by the transducer of the invention, it is feasible to use an electromagnetic loudspeaker, the sound waves of which are now regenerated or reradiated by the transducer of the invention. Preferably, the electromagnetic loudspeaker is a woofer such as a woofer of the acoustical or air suspension type. Such a structure has been illustrated in FIGS. 15 – 17 to which reference is now made. Here a plurality of woofers 114 are shown in a suitable enclosure 115 and are directly mounted, each behind a transducer 116 in accordance with the present invention. The electrostatic transducer may be constructed as previously disclosed. Alternatively, the diaphragm 117 may be supported separately in the front and rear of the plates. The fixed plates are disposed between the folds of the diaphragm. Because the forces acting on the plates are substantially balanced, there is no need for greater rigidity of the plates.

Since the loudspeaker 114 radiates sound against a hard but compliant surface, it has been found that the combination of the two transducers, that is the electromagnetic loudspeaker and the electrostatic transducer of the invention, will raise the frequency response of the electromagnetic device. The diaphragm of the structure of the invention is ideal for this purpose because it has a large surface and a very compliant but hard surface. Since it is folded, it will facilitate dispersion of the sound.

It will thus be evident that the combination structure shown in FIGS. 15 – 17 can be driven partially or entirely by electric signals or partially or entirely by sound waves which are then reradiated. The electromagnetic loudspeaker is very efficient for low frequencies. On the other hand, the transducer of the invention is highly efficient at high frequencies. Hence, the combination of the two is very efficient and will reproduce sound very faithfully. By way of example, a transducer of the invention may have a surface area of 100 sq. ft., one quarter of which may be driven by electric signals and the remaining three quarters of the surface by soundwaves so that sound below 40 hz and even below 20 hz can be faithfully reproduced.

As shown particularly by FIG. 17, the sound will disperse widely in an outward direction.

Figure 18:
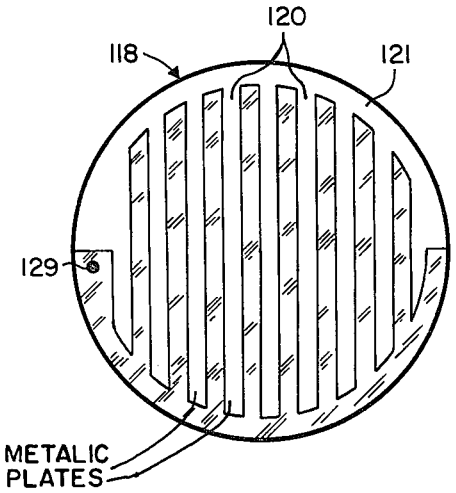
FIGS. 18, 19 and 20 are respectively a front elevational view, the same elevational view rotated through 180° and a side elevational view of a microphone in accordance with the present invention which may be represented by staggered plates.
Figure 20:
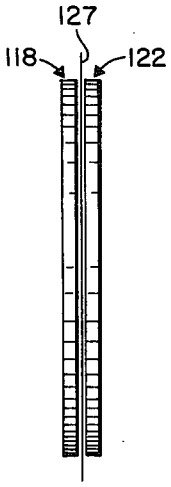
Figure 19:
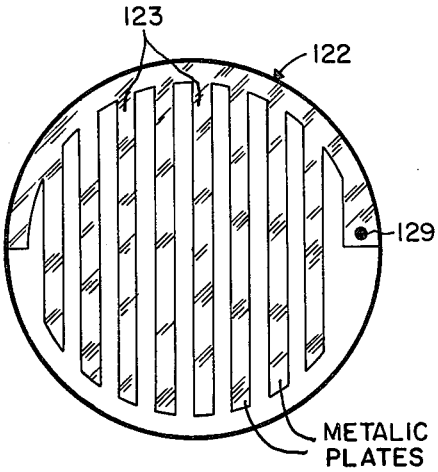

By way of example, FIGS. 18 – 20 illustrate a microphone embodying the principles of the present invention. FIG. 18 illustrates a plate 118 embodying a plurality of metallic plates 120 interconnected with a portion 121 formed by one half of an annulus. Similarly, FIG. 19 shows another plate 122 like plate 120 rotated through 180° having a plurality of metallic plates 123 interconnected with a portion 124 forming the corresponding half of the annulus. The two sets of plates 120 and 123 are staggered. The plates are reversible and may be put back to back as shown in FIG. 20. The diaphragm may consist of metal plated mylar or of an electret. Electrical connections may be made to the respective portions 121 and 124 by connectors 129 to provide a push pull microphone. The metallic portions are indicated by hatch marks. Instead of a microphone the structure may also be used as a tweater. The diaphragm is shown in 127 between the two plates 118 and 122.

Figure 21:
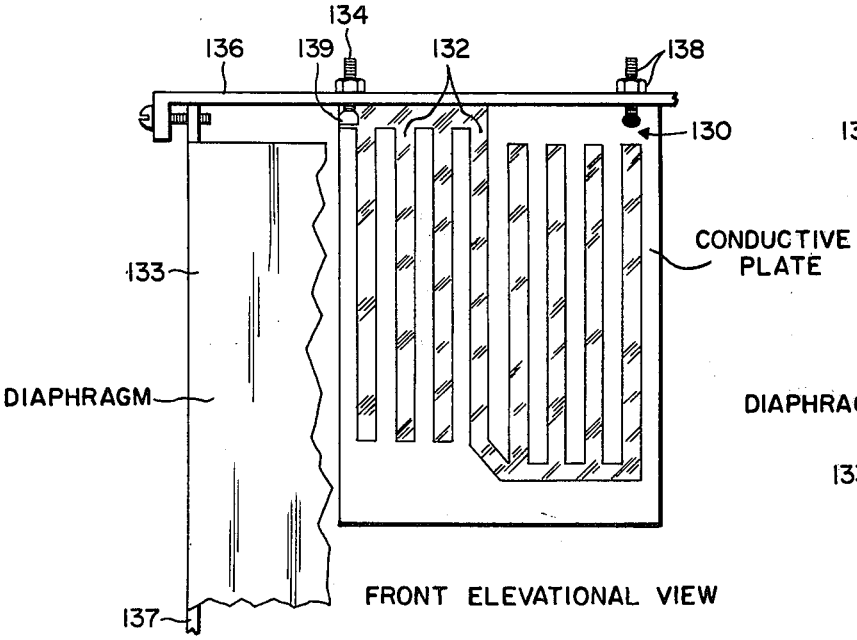
FIGS. 21 and 22 are respectively a front elevational view and a side elevational view of the transducer partially driven by electric signals and partially by sound waves and consisting of printed circuit boards.
Figure 22:
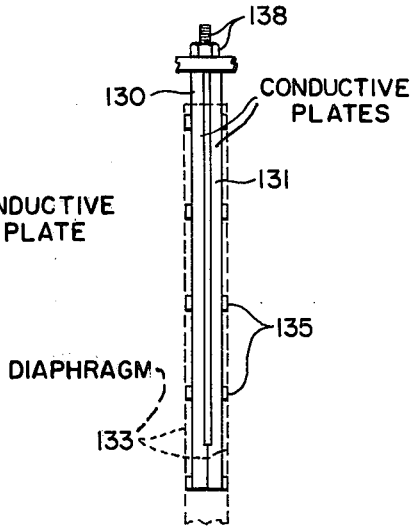

FIGS. 21 and 22 illustrate another embodiment of the invention which may be formed, for example, by printed circuit plates. Thus there may be a pair of printed circuit plates 130 and 131. Each of the plates is provided with conductive portions or fingers such as 132 which may, for example, consist of copper that has been suitably etched to provide the desired configuration. The conductive portions 132 are again indicated by hatching. The board may consist of fiberglass and may be laminated to a plastic sheet on the exposed metallic side to insulate the metal from the diaphragm 133. The electrical connection and support may be made by means of attached screws to a nut 134 and a connector 139 alternately electrically connected to the metallic structure and insulated. Felt strips 135 may be used to space the diaphragm 131 from the plates 132. Preferably, as shown in FIG. 21, the diaphragm 133 extends beyond the plate 132 so that the major portion of the transducer may be driven by acoustic waves. Also, the diaphragm is preferably suspended independently of the printed circuit boards by means of the frame 136 and the rods 137.

Preferably, the plates or fingers 132 are offset and staggered along the board. A pair of circuit boards may be identical but may be inverted so that a staggered pair of fingers or plates is obtained. One circuit board may be energized from the front and the other from the back. By way of example, the portion of the structure driven by electric signals may be 1 foot in height while the remainder of the structure driven by audio waves may be 3 feet in height.

The nut and screw 138 preferably is of insulating material such as nylon and serves as an additional support for the plate or printed circuit.

There has thus been disclosed an electrostatic transducer characterized by low capacitance and which therefore requires a minimum of driving power. The transducer may be so arranged that the sound wave which issues therefrom is dispersed to minimize the problem of standing waves. A modification of the transducer of the invention is capable of being driven either solely or partially by electric signals or sound waves. It has been found that a combination of the electrostatic transducer of the invention with a low frequency electromagnetic loudspeaker will cover the entire audio range with a minimum of distortion and with a minimum of driving power required. The diaphragm may consist of an electret which obviates the necessity for an electric biasing field.

What is claimed is:

1. An electrostatic transducer of the folded type comprising:

a. a plurality of electrically conductive plates disposed in substantially parallel, spaced planes;

b. an electrically conductive, flexible diaphragm, each of said plates extending only along a portion of the area of its associated diaphragm portion;

c. a supporting member disposed substantially in the plane of each of said plates for guiding said diaphragm and for maintaining it substantially parallel to and spaced from each of said plates, thereby to form consecutive loops;

d. means for adjusting the position of alternate supporting members individually along their planes with respect to the remaining plates thereby to tension said diaphragm and to vary the mechanical resonance of each plate associated diaphragm portion;

e. said means for adjusting including a tensioning spring disposed between each of one set of said supporting members and a fixed support; and f. means for generating a steady electric field between said plates and said diaphragm and for applying an electrical signal between alternate plates.

2. An electrostatic transducer of the folded type arranged to be partially driven by electric signals and partially by acoustic waves, said transducer comprising:

a. a plurality of electrically conductive plates disposed in substantially parallel spaced planes;

b. an electrically conductive, flexible diaphragm forming a continuous loop, each of said plates extending only along a portion of the area of its associated diaphragm portion;

c. means for spacing said diaphragm from and disposing it substantially parallel to said plates and for tensioning said diaphragm; and d. means for generating a steady electric field between said plates and said diaphragm and for applying an electric signal between alternate plates, whereby the diaphragm portions which are not coextensive with said plates are capable of being acoustically excited in phase with the diaphragm portions coextensive with said plates.

3. An electrostatic transducer as claimed in claim 2 wherein the area of said plates is on the order of less than one quarter the area of said diaphragm, whereby said diaphragm can be acoustically driven within the low acoustic frequency range.

4. An electrostatic transducer of the folded type comprising:

a. a plurality of electrically conductive plates disposed in substantially parallel, spaced planes;

b. an electrically conductive, flexible diaphragm, each of said plates extending only along a portion of the area of its associated diaphragm portion;

c. a supporting member disposed substantially in the plane of each of said plates for guiding said diaphragm and for maintaining it substantially parallel to and spaced from each of said plates, thereby to form consecutive loops;

d. means for adjusting the position of alternate supporting members individually along their planes with respect to the remaining plates thereby to tension sid diaphragm and to vary the mechanical resonance of each associated diaphragm portion; and e. means for generating a steady electric field between said plates and said diaphragm and for applying an electrical signal between alternate plates.

5. A transducer as defined in claim 4 wherein said consecutive loops disposed between said plates are of unequal length.

6. A transducer as defined in claim 4 wherein said plates extend over a portion of each of the loops formed by said diaphragm and disposed adjacent to its associated supporting member.

7. A transducer as defined in claim 4 wherein said plates are disposed spaced from their associated supporting members toward the center of said transducer.

8. A transducer as defined in claim 4 wherein means are provided for acoustically sealing the top and bottom edges of said diaphragm to prevent the egress of air therefrom.

9. A transducer as defined in claim 4 wherein the width of the slot formed by the adjacent supporting members varies.

10. A transducer as defined in claim 9 wherein the widths of said slots increases from the center toward the outside of said transducer.

11. A transducer as defined in claim 4 wherein a sound transparent insulating cover is provided to envelope said transducer.

12. An electrostatic transducer of the folded type comprising:

a. a plurality of electrically conductive plates disposed in substantially parallel, spaced planes;

b. an electrically conductive, flexible diaphragm, each of said plates extending only along a portion of the area of its associated diaphragm portion;

c. an insulating member disposed along one edge of each of said plates for guiding said diaphragm and for maintaining it substantially parallel to and spaced from each of said plates;

d. means for adjusting the position of alternate plates along their planes with respect to the remaining plates thereby to tension said diaphragm and to vary the electrical and mechanical resonance of each plate and its associated diaphragm portion;

e. a direct current voltage source connected between said plates and said diaphragm;

f. means for applying an electrical signal of opposite polarity between alternate plates; and g. an electrical resistor connected between at least two adjacent plates for controlling the amplitude of the signal applied to said adjacent plates.

13. In an electrostatic transducer of the folded type:

a. an electrically conductive plate adapted to have an electric signal applied thereto:

b. an electrically conductive, flexible diaphragm;

c. a first electrically insulating member of substantially cylindrical outline disposed over one edge of said plate for guiding said diaphragm over and around said plate;

d. a pair of electrically insulating members substantially coextensive with said plate and disposed spaced from and parallel to both said plate and said diaphragm for enclosing and guiding said diaphragm in spaced relationship with said plate; and e. a further insulating member disposed between said pair of insulating members for substantially enclosing said plate.

14. A transducer as defined in claim 13 wherein portions of said diaphragm between associated pairs of insulating members are of unequal dimensions.

15. An electrostatic transducer of the folded type comprising:

a. a first set of electrically conductive plates disposed in substantially parallel, spaced planes;

b. a second set of electrically conductive plates disposed in substantially parallel planes spaced from the planes of said first set, and each plate of said second set being spaced from each plate of said first set;

c. an electrically conductive, flexible diaphragm forming consecutive loops about each plate of said first and of said second set;

d. a first set of elongated, electrically insulating members, each being mounted on the front edge of one plate of said first set for guiding said diaphragm;

e. an elongated insulating member mounted on the rear edge of the plate of each second set for guiding said diaphragm into a series of continuous adjacent loops;

f. means for adjustably and individually tensioning each of the insulating members of said second set; and g. means for applying an electrical signal to each of said plates of said first set and in opposite polarity to each of said plates of said second set.

16. A transducer as defined in claim 15 wherein the plates of said first set and of said second set are of unequal length.

17. A transducer as defined in claim 15 wherein insulating spacing members are provided between each of said plates and the associated loop of said diaphragm and between adjacent loops of said diaphragm.

* * * * *